US011629500B2

(12) United States Patent
Pocius

(10) Patent No.: US 11,629,500 B2
(45) Date of Patent: Apr. 18, 2023

(54) FREESTANDING MODULAR SPIRAL STAIRCASE

(71) Applicant: Dale Pocius, Round Lake Heights, IL (US)

(72) Inventor: Dale Pocius, Round Lake Heights, IL (US)

( * ) Notice: Subject to any disclaimer, the term of this patent is extended or adjusted under 35 U.S.C. 154(b) by 88 days.

(21) Appl. No.: 17/247,953

(22) Filed: Dec. 31, 2020

(65) Prior Publication Data

US 2021/0131111 A1 May 6, 2021

Related U.S. Application Data

(63) Continuation of application No. 17/078,539, filed on Oct. 23, 2020, now abandoned.

(60) Provisional application No. 62/929,018, filed on Oct. 31, 2019.

(51) Int. Cl.
*E04F 11/032* (2006.01)
*E04F 11/04* (2006.01)
*E04F 11/02* (2006.01)

(52) U.S. Cl.
CPC ..... *E04F 11/032* (2013.01); *E04F 11/0201* (2013.01); *E04F 11/04* (2013.01); *E04F 2011/0203* (2013.01)

(58) Field of Classification Search
CPC ..... E04F 11/02; E04F 11/0201; E04F 11/032; E04F 11/022; E04F 11/035; E04F 11/038; E04F 11/04; E04F 2011/0203; E06C 1/397
USPC ..... 52/187
See application file for complete search history.

(56) References Cited

U.S. PATENT DOCUMENTS 3,013,640 A * 12/1961 Nehrbass ..... E04H 12/10 182/48
4,315,389 A * 2/1982 Loix ..... E04F 11/022 182/115
4,981,195 A * 1/1991 Merrick ..... E04F 11/0201 182/189
5,491,939 A * 2/1996 Wang ..... E04F 11/02 52/638
6,523,310 B1 * 2/2003 Tseng ..... E04F 11/032 52/182
7,258,199 B2 * 8/2007 Hayes, Sr. ..... E04G 27/00 182/178.1
9,555,335 B1 * 1/2017 Wilson ..... A63G 21/22
10,792,527 B1 * 10/2020 Mullen ..... A63B 24/0075
2011/0271613 A1 * 11/2011 Hopper ..... F03D 80/80 52/185

(Continued)

FOREIGN PATENT DOCUMENTS

WO WO-2010089792 A1 * 8/2010 ..... E04F 11/032

*Primary Examiner* — William V Gilbert
(74) *Attorney, Agent, or Firm* — Dunlap Bennett & Ludwig, PLLC

(57) ABSTRACT

A freestanding, adjustable, modular spiral staircase embodied in a unique method of spiral staircase design is provided. The steps of the spiral staircase are arrayed and supported in a circular pattern around a central column with the outside edges or leading or trailing corners of the steps are supported by three peripheral columns, while step posts interconnect adjacent steps. Many parts are interchangeable and the steps adjustable to allow for shortening or lengthening the staircase. The base of the staircase unit is heavy to provide maximum stability and to prevent tipping.

12 Claims, 3 Drawing Sheets

(56) References Cited

U.S. PATENT DOCUMENTS

2020/0399918 A1* 12/2020 Eckhardt ..... E04H 1/1205

* cited by examiner

FREESTANDING MODULAR SPIRAL STAIRCASE

CROSS-REFERENCE TO RELATED APPLICATION

This application claims the benefit of priority of U.S. non-provisional application Ser. No. 17/078,539 filed 23 Oct. 2020, the contents of which are herein incorporated by reference.

BACKGROUND OF THE INVENTION

The present invention relates to staircases and, more particularly, a freestanding modular spiral staircase.

Standard spiral staircases are limited in their usability and portability as they are fastened to walls, floors, ceilings, or all of the above. They are not stable enough to be freestanding, and so usually rely on attachment to other surfaces and structures to support their weight. As a result of being attached in place, rearrangement and repositioning of the staircase as one would other furniture items is usually not possible, and most people would just assume such a proposition could not work or would be dangerous, in part because a standard spiral staircase is accurately seen as too heavy by design to be easily moved from one location to another.

Another, separate problem with the standard spiral staircase is the height cannot be scaled up or down to reach different levels in a room—it is initially designed to a certain height and cannot be changed.

As can be seen, there is a need for a freestanding modular spiral staircase having interlocking parts that are interchangeable and adjustable to allow for differing heights of a freestanding, modular staircase construction. Once assembled, the present invention can be easily moved from one location to another since it is light enough to be carried by one person, and no other supporting structures are needed for stability, as its unique design results in a natural compressive strength providing both structural integrity and stability, when all the components are fastened tightly.

SUMMARY OF THE INVENTION

In one aspect of the present invention, a freestanding spiral staircase includes the following: a base; a top platform; a center post extending between the base and the top platform; a plurality of triangular steps, wherein an acute vertex of each triangular step is connected to the center post in such a way as to form a helical configuration along a longitudinal axis of the center post; a plurality of peripheral posts extending from just inward of a periphery of the base to a corner of one of the plurality of triangular steps; and each peripheral post is connected to at least one step of the plurality of triangular steps; a step post interconnecting corners of two adjacent triangular steps of the plurality of triangular steps, wherein the base is a triangle, and wherein one of the plurality of peripheral posts extends from each respective corner of the triangle, wherein the base has a base mass at least twice a top mass of the top platform, wherein a bottom step post interconnects the base and the triangular step of the plurality of triangular steps closest to the base, wherein a top step post interconnects the top platform and the triangular step of the plurality of triangular steps closest to the top platform; a foot connected to an underside of the base adjacent to each peripheral post, wherein the acute vertex is the vertex of the triangular step furthest from a centroid of said triangular step.

In another aspect of the present invention, the freestanding spiral staircase, includes the following: a base; a top platform; a center post extending between the base and the top platform; a plurality of triangular steps, wherein an acute vertex of each triangular step is connected to the center post in such a way as to form a helical configuration along a longitudinal axis of the center post; a plurality of peripheral posts extending from just inward of a periphery of the base to the top platform, wherein each peripheral post operatively associates with a vertex of at least one of the triangular steps of the plurality of triangular steps; and a step post interconnecting vertices of each two adjacent triangular steps of the plurality of triangular steps if neither of said two adjacent triangular steps is operatively associated with one of the plurality of peripheral posts, wherein operatively association includes a hole through a respective vertex.

These and other features, aspects and advantages of the present invention will become better understood with reference to the following drawings, description and claims

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a freestanding, adjustable, modular spiral staircase embodied in a unique method of spiral staircase design. The steps of the spiral staircase are arrayed and supported in a circular pattern around a central column with the outside edges or leading or trailing corners of the steps are supported by three peripheral columns, while step posts interconnect adjacent steps. Many parts are interchangeable and the steps adjustable to allow for shortening or lengthening the staircase. The base of the staircase unit is heavy to provide maximum stability and to prevent tipping.

Figure 1:
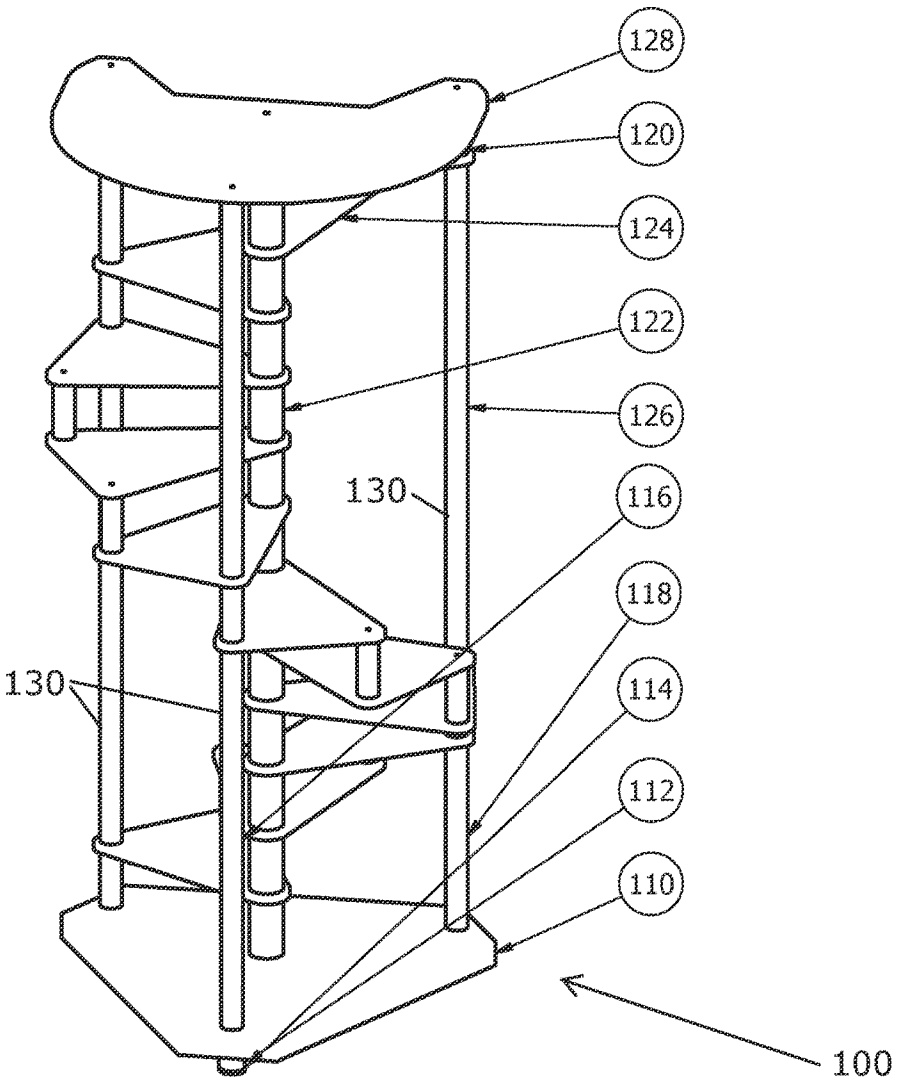
FIG. 1 is a front top perspective view of an exemplary embodiment of the present invention.
Figure 4:
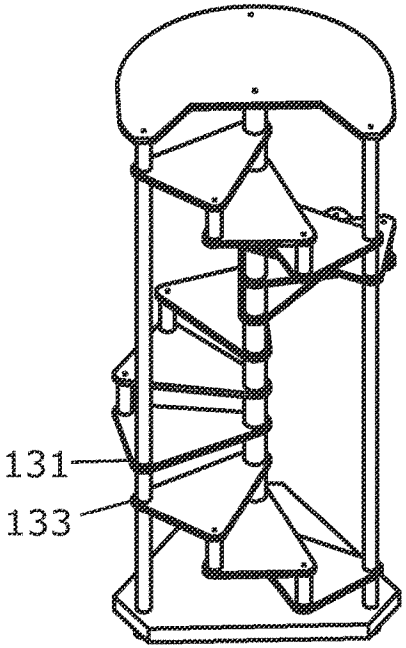
FIG. 4 is a rear top perspective view of an exemplary embodiment of the present invention.
Figure 3:
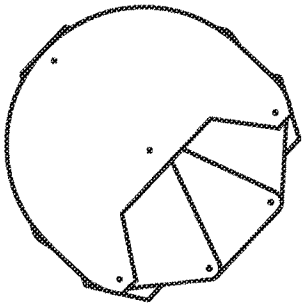
FIG. 3 is a top plan view of an exemplary embodiment of the present invention.
Figure 2:
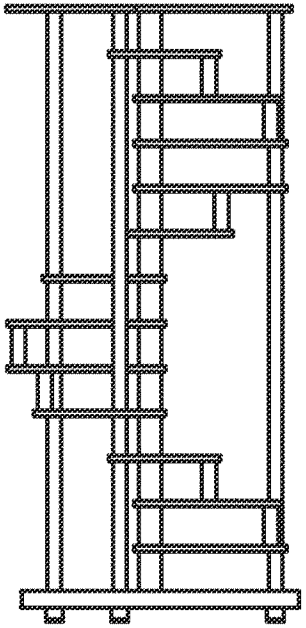
FIG. 2 is a front elevation view of an exemplary embodiment of the present invention.
Figure 6:
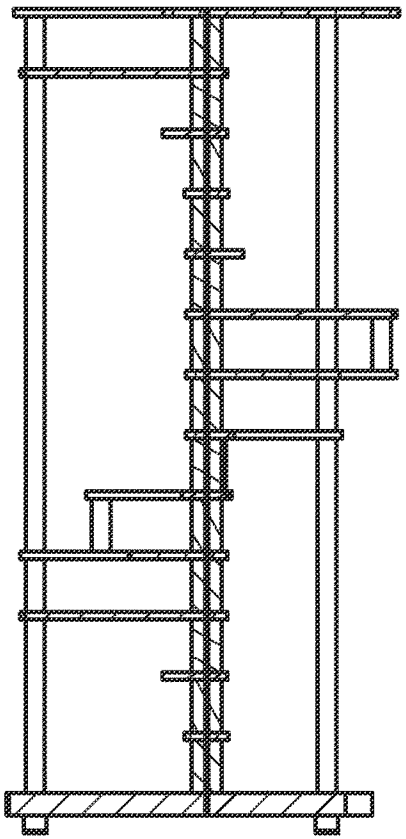
FIG. 6 is a section view of an exemplary embodiment of the present invention, taken along line 6-6 in FIG. 5.
Figure 5:
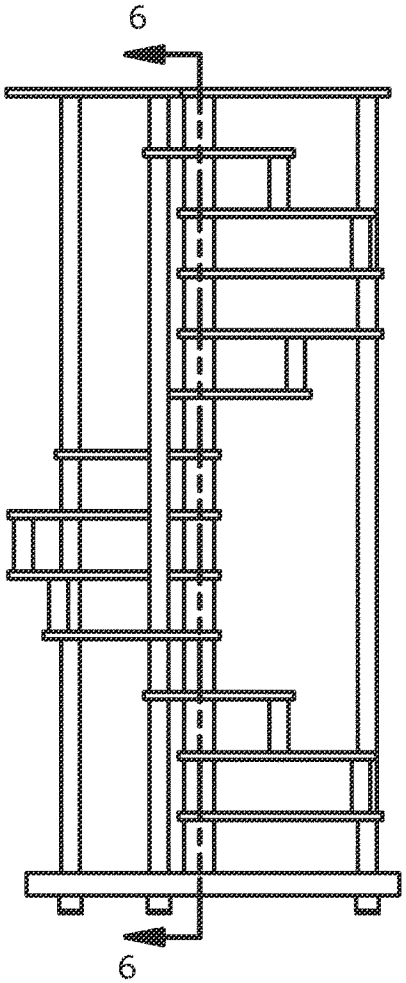
FIG. 5 is a front elevation view of an exemplary embodiment of the present invention.

Referring now to FIG. 1, the present invention may include a freestanding modular spiral staircase 100 having the following systemic components.

A base 110 or solid platform to serve as the foundation of the present invention. In certain embodiments, the base 110 may be triangular, as illustrated in the FIGS., but other shapes including non-geometric shapes can also be used. The base 110 may have a flat top and bottom surfaces to which other components of the present invention are attached to. One method for attaching components to the base 110 are via drilled holes in the center and outside corners. In one embodiment, the material for the base 110 may be solid wood or plastic, though any material having the durability and the strength-to-weight ratio suitable to enable the functionality disclosure herein would be acceptable. Similarly, other methods of attachment are possible as long as the present invention functions as disclosure herein.

Feet 112 may be attached to the flat bottom surface of the base 110, in certain embodiments by way of holes drilled through the base 110.

Pads 114 may be attached to the feet 112, in certain embodiment, via adhesives such as glue or a self-stick application. The feet 112 and pads 114 may be attached just inward of the periphery of the base 110, such as under the outside corners thereof. The pads 114 serve as protection for floors and surfaces the present invention is resting on. Other embodiments are possible and are not limited to the above examples.

A step post 120, a short post 118, and a medium post 116, are attached to the top surface of the base 110, in certain embodiments, with screws threaded into holes drilled in the base 110. These posts 120, 118, and 116 are mounted on the outside upper corners of the base 110.

A center post 122 is attached to the top center of the base 110, in certain embodiments, with screws or other fasteners. Posts 120, 118, 116, 122 as well as other posts of the present invention are may be made of a solid heavy-duty material such as wood, plastic, metal, or other strong materials. The above-mentioned posts can also be hollow or semi hollow. Other embodiments are possible and are not limited to the above examples.

A step 124 may be attached to the center post 122, in certain embodiments, with a screw via a hole drilled through step 124. This process is continued one above another until a plurality of step 124 are assembled—in one embodiment of the present invention there are twelve (12) steps 124. Each step 124 may be rotated 40° (angle of offset) in a clockwise direction as they are placed above one another in this embodiment, creating a three-dimensional curve that turns around a longitudinal axis of the center post 122 at a constant or continuously varying distance while moving parallel to the axis, or in other words a helix or helical configuration. Of course, other embodiments could have more steps 124 or less steps 124 than shown in the appended FIGS.

In between each step 124 is mounted a step post 120, in certain embodiments, with screws attached through holes in step 124. In certain embodiments, with twelve (12) steps 124, thirteen (13) step posts 120 are used, as shown in FIG. 1, as the lowest step 124 has a step post 120 interconnecting it and the base 110; likewise, the uppermost step 124 has a step post 120 interconnecting it and a top platform 128.

In other embodiments, there may be a plurality of peripheral posts 130 that extend between the base 110 and the top platform 128, wherein each peripheral post 130 attaches to at least one triangular step 124, at a leading corner 131, and in yet another embodiment, at least two triangular steps 124, at a leading corner 131 of one triangular 124 and the trailing corner 133 of the other triangular step 124. The angle of offset may be adjusted so that the leading and trailing corners 131 and 133 of the one or two steps operatively associated with the relevant peripheral post 130, typically by a hole in the relevant corner 131 or 133 that the post slides through. The corner 131 or 133 may still be connected to the slide-through post 130.

Three types of posts support the outside edges of the present invention if it is constructed bottom to top. They are short post 118, medium post 116, long post 126. These posts are preferably made of a solid heavy-duty material such as wood, plastic, metal, or glass. These three types of posts are attached to any steps 124 they meet as they rise straight up from the three corners of the base 110. The above-mentioned posts can also be hollow or semi hollow. The attachment method is preferably using screws but not limited to that method. Other embodiments are possible and are not limited to the above examples.

The top platform 128 is attached to center post 122, short post 118, medium post 116, and step post 120 at the very top of the present invention. Screws or other fasteners may attach the top platform 128 to these posts 122, 118, 116, and 120. The top platform 128 can be made of wood, plastic, glass, metal, or other materials. In certain embodiments, a padded surface of carpeting, foam, cloth, or other soft material is attached to the top platform 128. A pattern, logo, picture, or other indicia may be added to the top platform 128 for decorative purposes. Other embodiments are possible and are not limited to the above examples.

The present invention provides a unique method of spiral staircase design that is modular, adaptable, and movable. The steps of the spiral staircase are arrayed and supported in a circular pattern around a central column with the outside edges of the steps supported by three peripheral columns. The step height of the stairs may be fifty percent of normal step height in homes to accommodate pets. The parts are interchangeable to allow for shortening or lengthening the staircase. The base of the staircase unit is purposely heavy to provide maximum stability and prevent tipping.

A base platform may be made by gluing two sheets of wood together, sanding and painting, and drilling holes for assembly. Various sized posts are cut, sanded, painted, and drilled to be used for uprights in the staircase. Triangular steps may be fashioned from wood, sanded, drilled, and painted for the treads. The top cushion piece may be fashioned from wood with a foam layer on top and then covered in flannel cloth. All parts are screwed together with galvanized fasteners.

The base, support posts, and steps are necessary. The top cushion is optional. Gripping texture, such as rubber treads could be glued to steps to provide more traction for users.

The resulting freestanding modular spiral staircase can now be moved anyplace where it is needed to climb on. It can also be shortened or lengthened as needed to reach different heights. Additionally, the staircase can be used as a display shelving unit to put items on, as well as being a pet climbing ladder.

It should be understood, of course, that the foregoing relates to exemplary embodiments of the invention and that modifications may be made without departing from the spirit and scope of the invention as set forth in the following claims.

What is claimed is:

1. A freestanding spiral staircase, comprising:

a base;

a top platform;

a center column extending between the base and the top platform;

a plurality of triangular steps, wherein an acute vertex of each said triangular step is connected to the center column in such a way as to form a helical configuration along a longitudinal axis of the center column; and a plurality of peripheral columns extending from the base to the top platform, wherein each said peripheral column slidably connects with a vertex of at least one adjustable triangular step of the plurality of triangular steps so that differing heights of the freestanding spiral staircase are selectively adjustable, wherein each said peripheral column engages two adjacent adjustable triangular steps of the plurality of triangular steps, wherein the peripheral column slidably connects to a leading vertex of one and a trailing vertex of another of said two adjacent adjustable triangular steps, and wherein a trailing vertex and a leading vertex of each said intermediate triangular step of the plurality of triangular steps is interconnected by way of a step post, respectively, to separate adjacent adjustable triangular steps of the plurality of triangular steps.

2. The freestanding spiral staircase of claim 1, wherein the peripheral columns extend from just inward of a periphery of the base.

3. The freestanding spiral staircase of claim 2, wherein the base is a triangle, and wherein each said peripheral column extends from each said respective corner of the triangle.

4. The freestanding spiral staircase of claim 3, wherein the base has a base mass at least twice a top mass of the top platform.

5. The freestanding spiral staircase of claim 4, further comprising a foot connected to an underside of the base adjacent to each said peripheral column.

6. The freestanding spiral staircase of claim 5, wherein the acute vertex is the vertex of the triangular step furthest from a centroid of said triangular step.

7. A freestanding spiral staircase, comprising:

a base;

a top platform;

a center column extending between the base and the top platform;

a plurality of steps, wherein a proximal portion of each said step is connected to the center column in such a way as to form a helical configuration along a longitudinal axis of the center column; and a plurality of peripheral columns extending from the base to the top platform, wherein each said peripheral column slidably connects with a distal portion of at least one adjustable step of the plurality of steps so that differing heights of the freestanding spiral staircase are selectively adjustable, wherein each said peripheral column engages two adjacent steps of the plurality of steps, wherein the peripheral column slidably connects to a leading distal portion of one and a trailing distal portion of another of said two adjacent adjustable steps, and wherein a trailing vertex and a leading vertex of each said intermediate step of the plurality of steps is interconnected by way of a step post, respectively, to separate adjacent adjustable steps of the plurality of steps.

8. The freestanding spiral staircase of claim 7, wherein the peripheral columns extend from just inward of a periphery of the base.

9. The freestanding spiral staircase of claim 8, wherein the base is a triangle, and wherein each said peripheral column extends from each said respective corner of the triangle.

10. The freestanding spiral staircase of claim 9, wherein the base has a base mass at least twice a top mass of the top platform.

11. The freestanding spiral staircase of claim 10, further comprising a foot connected to an underside of the base adjacent to each said peripheral column.

12. A freestanding spiral staircase, comprising:

a base;

a top platform;

a center column extending between the base and the top platform;

a plurality of steps, wherein a proximal portion of each said step is connected to the center column in such a way as to form a helical configuration along a longitudinal axis of the center column; and a plurality of peripheral columns extending from the base to the top platform, wherein each said peripheral column slidably connects with a distal portion of at least one adjustable step of the plurality of steps so that a step height between each said adjustable step and an adjacent step of the plurality of steps is selectively adjustable, wherein the center column extends along a longitudinal axis, and wherein each said step height is defined by a distance parallel to the longitudinal axis, wherein each said peripheral column engages two adjacent steps of the plurality of steps, wherein the peripheral column slidably connects to a leading distal portion of one and a trailing distal portion of another of said two adjacent adjustable steps, and wherein a trailing vertex and a leading vertex of each said intermediate step of the plurality of steps is interconnected by way of a step post, respectively, to separate adjacent adjustable steps of the plurality of steps.

* * * * *